US010668399B2

(12) United States Patent
Weigl, Jr.

(10) Patent No.: US 10,668,399 B2
(45) Date of Patent: Jun. 2, 2020

(54) AUTOMATIC BUBBLE DISPENSING WAND

(71) Applicant: James Anton Weigl, Jr., Virginia Beach, VA (US)

(72) Inventor: James Anton Weigl, Jr., Virginia Beach, VA (US)

( * ) Notice: Subject to any disclaimer, the term of this patent is extended or adjusted under 35 U.S.C. 154(b) by 0 days.

(21) Appl. No.: 16/104,736

(22) Filed: Aug. 17, 2018

(65) Prior Publication Data

US 2020/0054959 A1 Feb. 20, 2020

(51) Int. Cl.
*A63H 33/28* (2006.01)

(52) U.S. Cl.
CPC ..... *A63H 33/28* (2013.01)

(58) Field of Classification Search
CPC ..... A63H 33/28; F41B 15/02
See application file for complete search history.

(56) References Cited

U.S. PATENT DOCUMENTS 2,015,301 A * 9/1935 Delvaux ..... A63H 33/28 446/20
2,226,949 A * 12/1940 Simpson ..... G10G 7/00 84/477 B
2,812,683 A * 11/1957 Harrold ..... G10G 7/00 84/477 B
2,918,839 A * 12/1959 Kaplan ..... G10G 7/00 84/477 B
2,988,949 A * 6/1961 Rohmann ..... G10G 7/00 84/477 B
3,100,947 A * 8/1963 Hellman ..... A63H 33/28 446/16
3,636,811 A * 1/1972 Bailey ..... G10G 7/00 84/477 B
5,224,893 A * 7/1993 Routzong ..... A63H 33/28 446/15
5,540,608 A * 7/1996 Goldfarb ..... A63H 5/00 446/15
6,142,845 A * 11/2000 Feldman ..... A63H 3/20 40/419
2002/0061697 A1* 5/2002 Hornsby ..... A63H 33/28 446/15
2013/0125991 A1* 5/2013 Lau ..... A63H 33/28 137/1

* cited by examiner

*Primary Examiner* — Eugene L Kim
*Assistant Examiner* — Alyssa M Hylinski
(74) *Attorney, Agent, or Firm* — Duncan G. Byers

(57) ABSTRACT

The automatic bubble dispensing wand is a portable and ergonomic apparatus that emits bubbles. The apparatus includes an elongated housing, at least one dispensing assembly, at least one fan mechanism, a motor, a pump, a solution reservoir, a microcontroller, and a power source. The elongated housing includes a handle portion, at least one dispensing end, at least one outlet, and an inlet. The handle portion is preferably positioned between a first dispensing end and a second dispensing end. The at least one dispensing assembly and the at least one fan mechanism are mounted within the at least one dispensing end. The motor, the pump, the solution reservoir, the microcontroller, and the power source are mounted within the handle portion. The at least one outlet traverses into the at least one dispensing end, and the inlet traverses into the handle portion.

13 Claims, 6 Drawing Sheets

AUTOMATIC BUBBLE DISPENSING WAND

FIELD OF THE INVENTION

The present invention generally relates to automatic bubble dispensers. More specifically, the present invention is an automatic bubble dispensing wand.

BACKGROUND OF THE INVENTION

Bubble toys are a staple of childhood experiences. Bubble toys include the traditional bubble jar and wand that requires a user to blow into the wand. Bubble toys also include automatic dispensers that are either mounted onto a surface or controlled by a trigger.

It is an objective of the present invention to enhance current bubble toys. The present invention allows bubbles to be emitted while being maneuvered by a user. The present invention serves as a new delivery system of bubbles. The present invention allows a user to play with and perform a variety of moves while emitting bubbles. The exterior of the present invention is enhanced as the solution is contained within an elongated housing. The ergonomic structure of the present invention is defined as the elongated housing comprises a handle portion and at least one dispensing end, moreover, a first dispensing end and a second dispensing end.

DETAIL DESCRIPTIONS OF THE INVENTION

Figure 1:
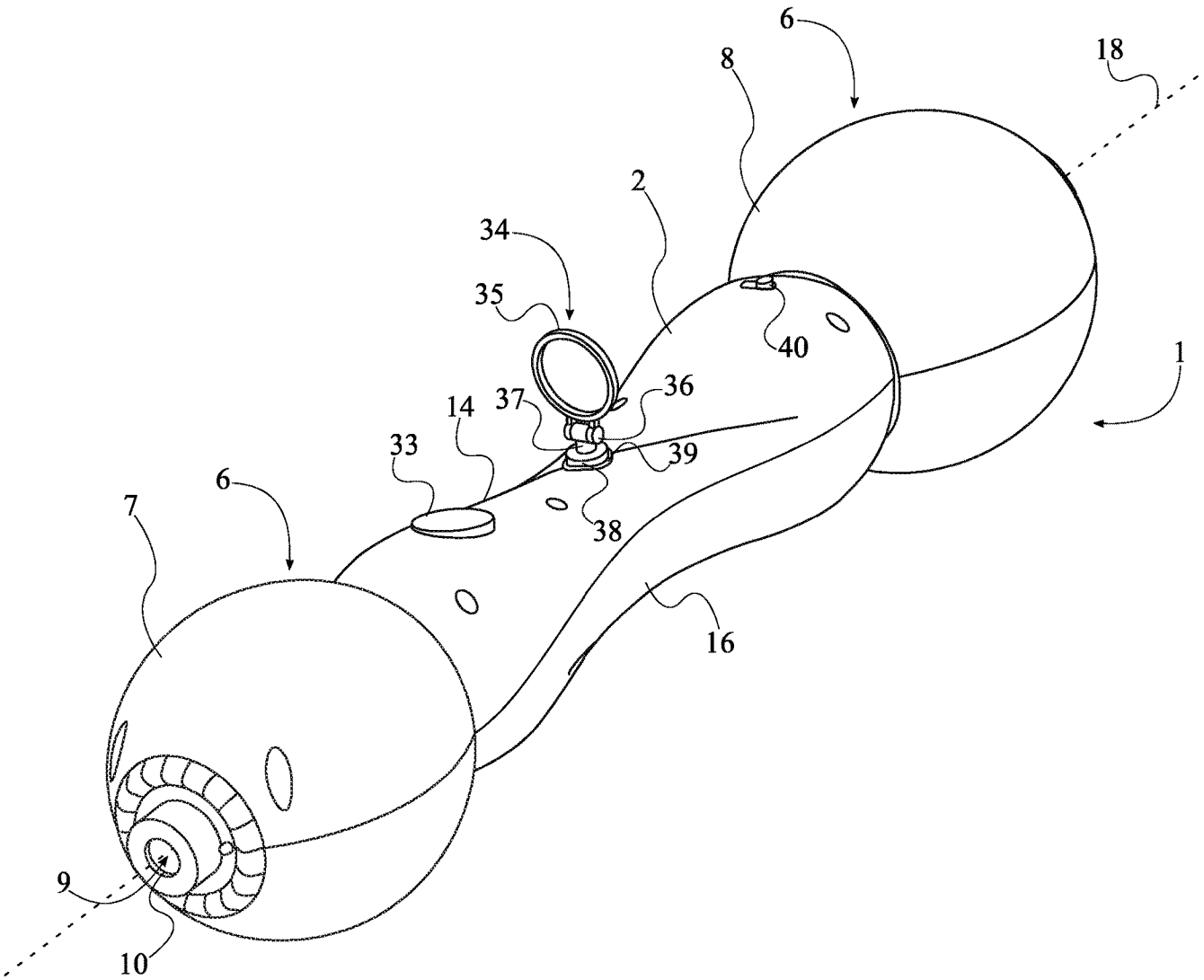
FIG. 1 is a perspective view of the present invention.
Figure 2:
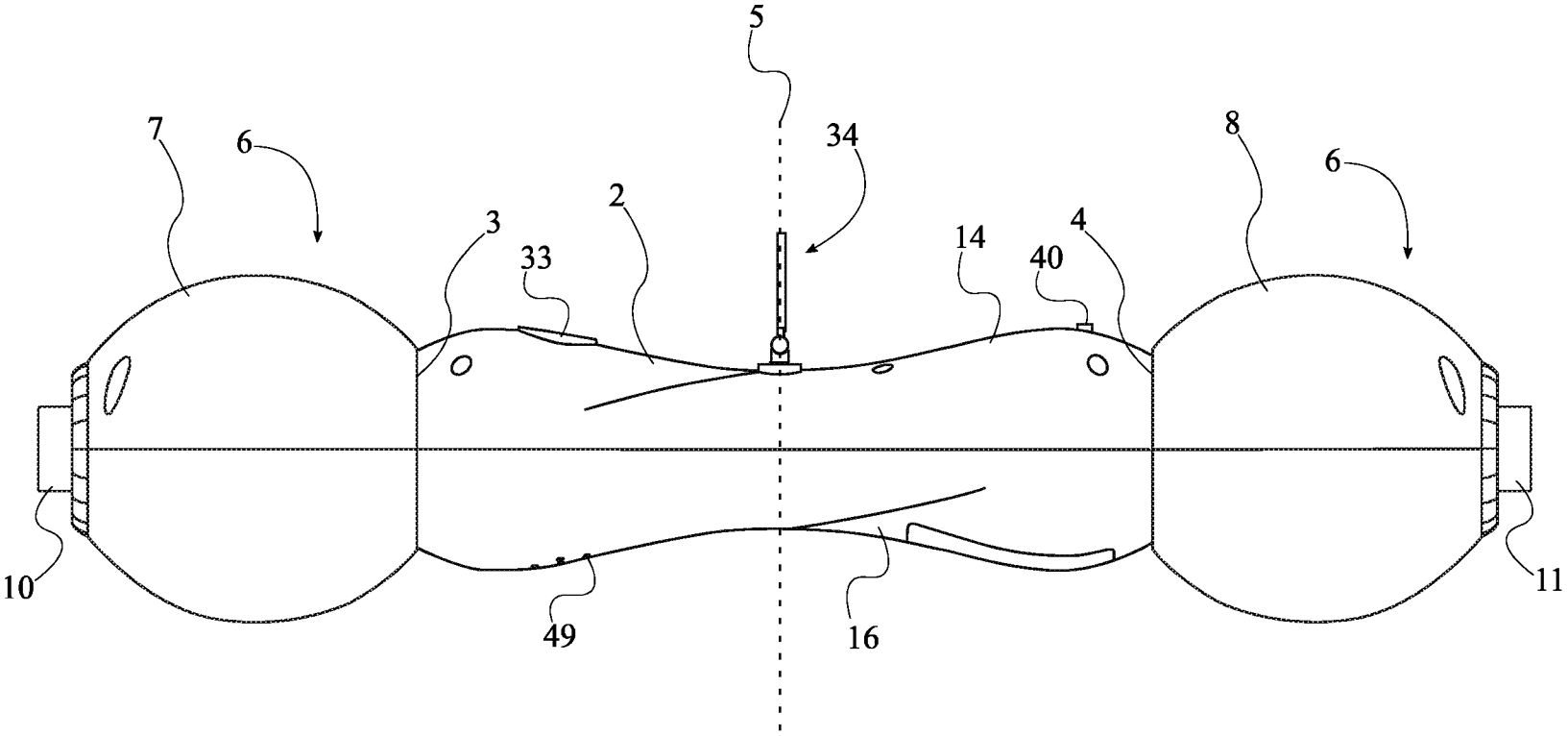
FIG. 2 is a side view of the present invention.
Figure 3:
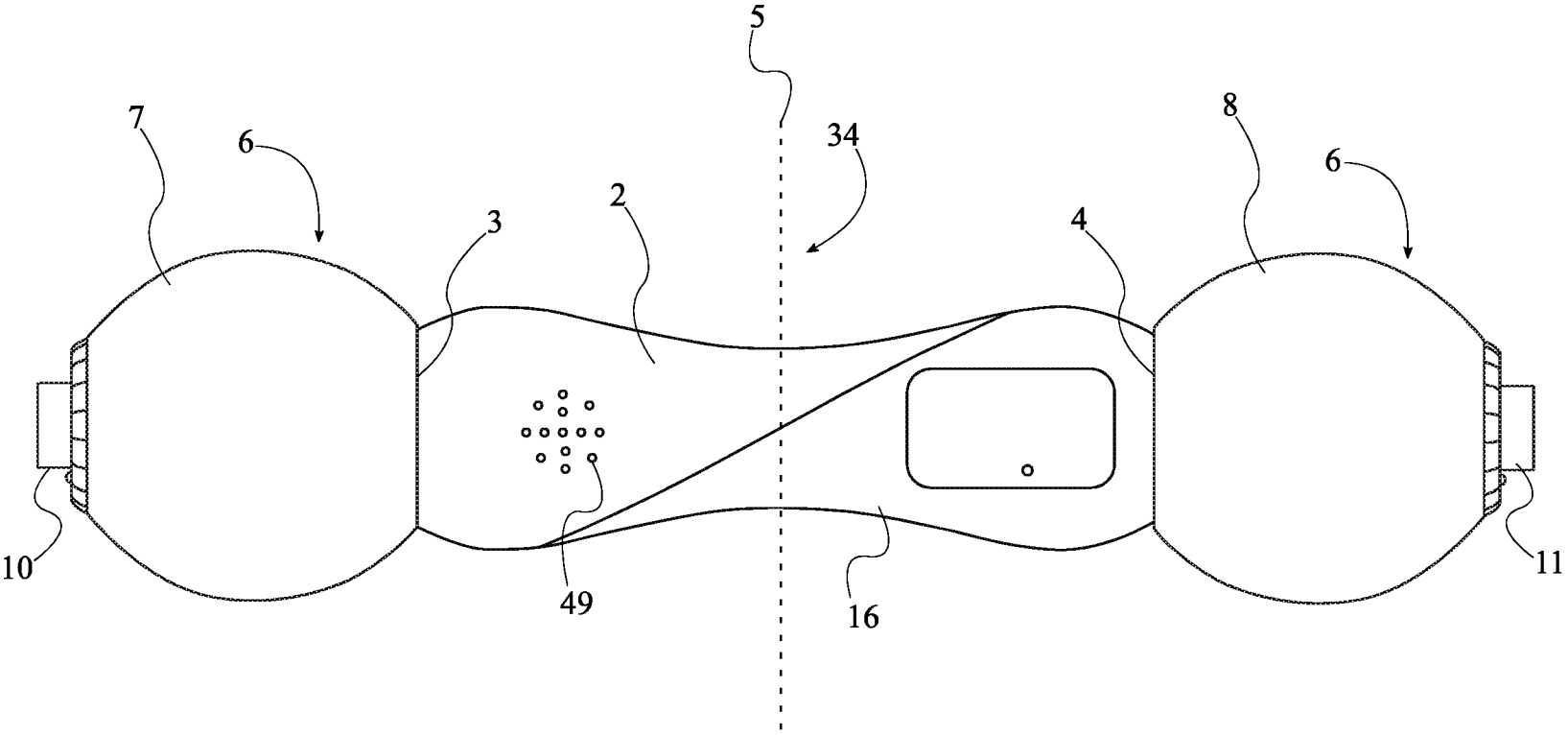
FIG. 3 is a bottom view of the present invention.
Figure 4:
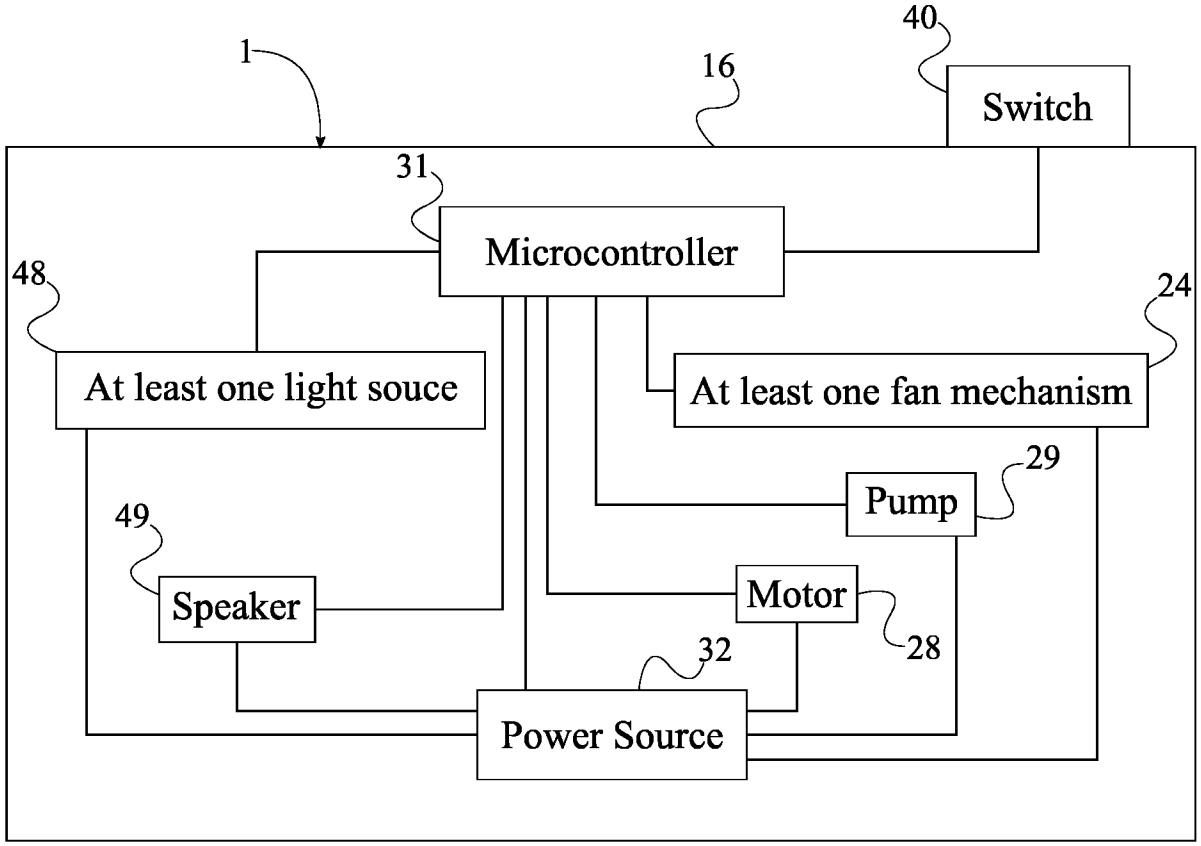
FIG. 4 is a schematic view of the electronic connections of the present invention.
Figure 5:
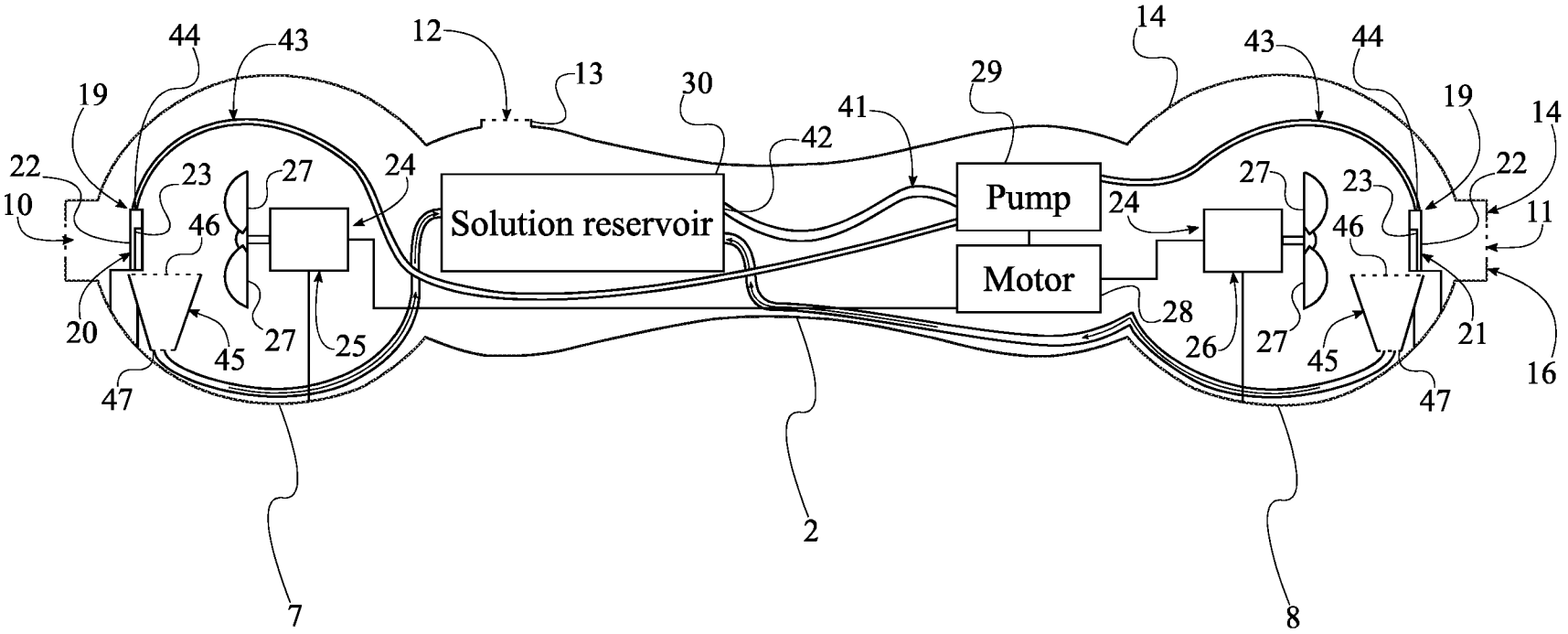
FIG. 5 is a schematic view of an at least one dispensing assembly and an at least one fan mechanism of the present invention.
Figure 6:
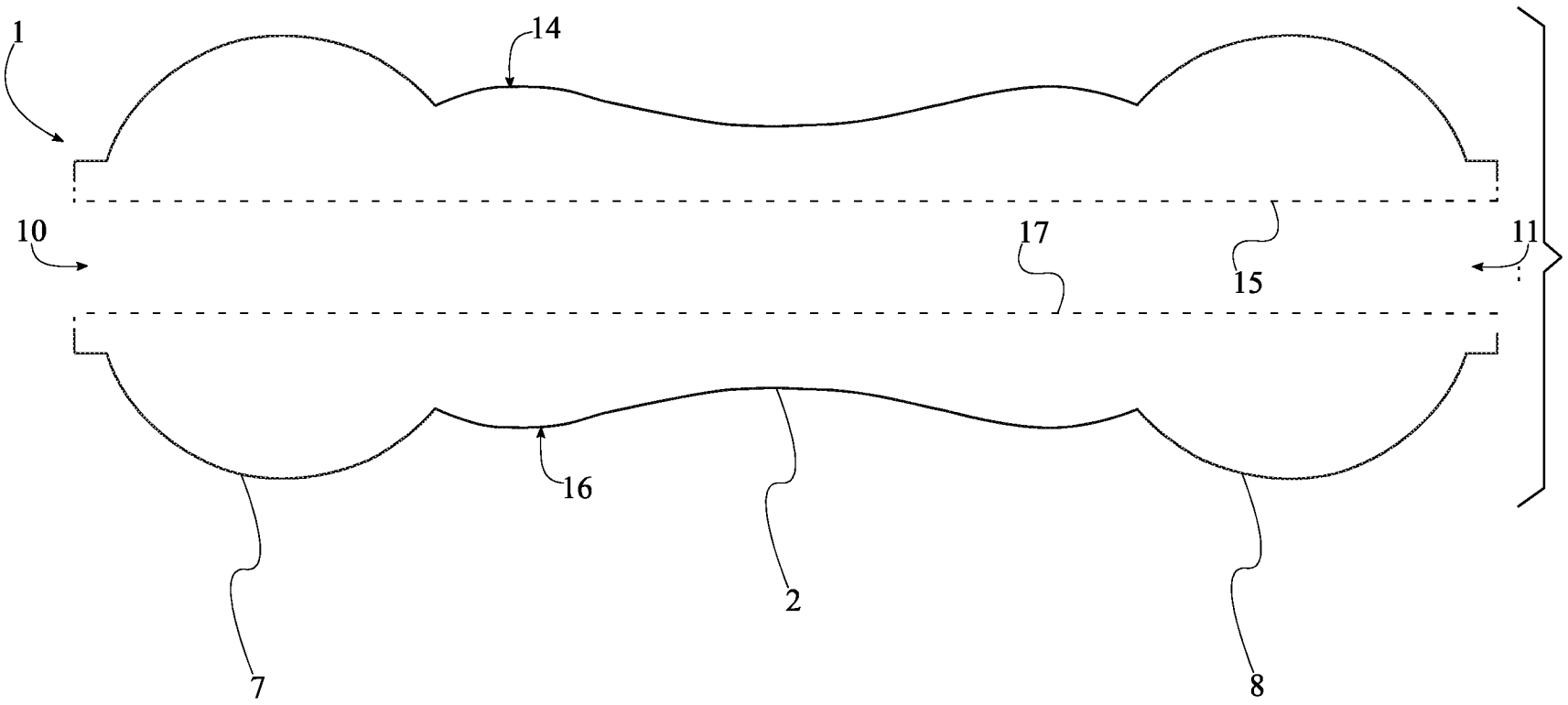
FIG. 6 is a schematic view of a first elongated case and a second elongated case of the present invention.

All illustrations of the drawings are for the purpose of describing selected versions of the present invention and are not intended to limit the scope of the present invention.

The present invention is an automatic bubble dispensing wand. The present invention allows bubbles to be dispensed and comprises an ergonomic structure that allows a user to maneuver the path of the distribution of bubbles. In order for the present invention to be easily maneuverable while effectively emitting bubbles, the present invention comprises an elongated housing 1, at least one dispensing assembly 19, at least one fan mechanism 24, a motor 28, a pump 29, a solution reservoir 30, a microcontroller 31, and a power source 32. The elongated housing 1 contains the at least one dispensing assembly 19, the at least one fan mechanism 24, the motor 28, the pump 29, the solution reservoir 30, the microcontroller 31, and the power source 32. The elongated housing 1 accommodates the contours of the grip of the user as the elongated housing 1 comprises a handle portion 2 and at least one dispensing end 6. The elongated housing 1 allows bubbles to exit the housing as the elongated housing 1 comprises the at least one outlet 9. The present invention is refillable, and therefore reusable, as the elongated housing 1 comprises an inlet 12. The at least one dispensing assembly 19 dispenses bubbles solution from the solution reservoir

30 with the motor 28 and the pump 29 to the at least one fan mechanism 24. The at least one fan mechanism 24 generates air flow, creating bubbles with the at least one dispensing assembly 19. The power source 32 provides the necessary power for the at least one fan mechanism 24, the motor 28, the pump 29, and the microcontroller 31. The power source 32 is preferably at least one replaceable battery. It is understood that various embodiments of the present invention may comprise a power source 32 that is rechargeable.

The overall arrangement of the aforementioned components allows the present invention to automatically emit bubbles while being maneuvered by a user. The at least one dispensing end 6 is terminally positioned adjacent the handle portion 2, allowing the user to direct the emission of bubbles with the handle portion 2. The at least one outlet 9 traverses into the at least one dispensing end 6, and the inlet 12 traverses into the handle portion 2. This arrangement allows the user to grasp onto the handle portion 2 without inhibiting the emission of bubbles. In order for the present invention to be maneuverable, the at least one dispensing assembly 19, the at least one fan mechanism 24, the motor 28, the pump 29, the solution reservoir 30, the microcontroller 31, and the power source 32 are positioned within the elongated housing 1. The present invention is portable as the solution supply is in fluid communication with the pump 29, and the pump 29 is in fluid communication with the at least one dispensing assembly 19. The present invention is automatic as the microcontroller 31 is electronically connected to the at least one fan mechanism 24, the motor 28, and the pump 29. Moreover, the power source 32 is electrically connected to the micro controller, the at least one fan mechanism 24, the motor 28, and the pump 29.

In the preferred embodiment of the present invention, the at least one dispensing end 6 comprises a first dispensing end 7 and a second dispensing end 8. The first dispensing end 7 and the second dispensing end 8 allows bubbles to be dispersed from either end of the handle portion 2. Moreover, the at least one outlet 9 comprises a first outlet 10 and a second outlet 11. The first dispensing end 7 is positioned adjacent the handle portion 2. Similarly, the second dispensing end 8 is positioned adjacent the handle portion 2, opposite the first dispensing end 7. Both the first dispensing end 7 and the second dispensing end 8 comprise orb-like structures that complement the emission of bubbles. The bubbles exit the elongated housing 1 as the first outlet 10 traverses into the first dispensing end 7, and the second outlet 11 traverses into the second dispensing end 8.

The elongated housing 1 is ergonomic as the handle portion 2 tapers from a first distal end 3 of the handle portion 2 to a central plane 5 of the handle portion 2. Similarly, the handle portion 2 also tapers from a second distal end 4 of the handle portion 2 to the central plane 5 of the handle portion 2. The first distal end 3 is positioned opposite the second distal end 4 across the handle portion 2. This arrangement positions the grip of the user along the handle portion 2 and allows the grip of the user to effectively surround the handle portion 2.

The at least one dispensing assembly 19, the at least one fan mechanism 24, the motor 28, the pump 29, the solution reservoir 30, the microcontroller 31, and the power source 32 are easily accessible as the elongated housing 1 further comprises a first elongated case 14 and a second elongated case 16. The first elongated case 14 encloses the second elongated case 16 and the components within the elongated housing 1. The second elongated case 16 contains the components within the elongated housing 1. In order to contain components within the elongated housing 1, an opening 15 of the first elongated case 14 is positioned adjacent an opening 17 of the second elongated case 16. Moreover, the first elongated case 14 is coextensive with the second elongated case 16. The at least one dispensing assembly 19, the at least one fan mechanism 24, the motor 28, the pump 29, the solution reservoir 30, the microcontroller 31, and the power source 32 is mounted within the second elongated case 16, allowing for the continuous emission of bubbles while the user maneuvers the elongated housing 1. The first elongated case 14 is removably attached to the second elongated case 16 in order for the user to access the components within the elongated housing 1. The user may need to replace the power source 32 or fix any malfunctioning components within the second elongated case 16. As the components within the elongated housing 1 are mounted within the second elongated case 16, the inlet 12 preferably traverses through the first elongated case 14.

The inlet 12 is sealed as the present invention further comprises a cap 33. The cap 33 prevents any bubble solution from spilling out of the solution reservoir 30. The cap 33 is externally positioned adjacent the elongated housing 1 and is removably attached to a rim 13 of the inlet 12. Moreover, the cap 33 is preferably threadedly engaged with the rim 13 of the inlet 12. It is understood, however, that various embodiments may comprise a variety of fastening means that allows the cap 33 to seal the inlet 12 and be separable from the inlet 12.

An alternate embodiment of the present invention comprises a spinning mechanism 34. The spinning mechanism 34 allows the present invention to be rapidly spun and securely grasped by the user. In order for the spinning mechanism 34 to be rapidly spun while being held by the user, the spinning mechanism 34 comprises a ring 35, a clevis 36, a shaft 37, a rotating base plate 38, and a stationary base plate 39. The ring 35 allows the user to hold the present invention without inhibiting the rotation of the elongated housing 1. The clevis 36 allows the ring 35 to pivot and widen the range of motion of the spinning mechanism 34. The shaft 37 connects the ring 35 to the rotating base plate 38. The rotating base plate 38 and the stationary base plate 39 allows the shaft 37 and the elongated housing 1 to spin. The user is able to grasp the present invention, while the elongated housing 1 is spinning as the ring 35 is hingedly engaged to the shaft 37 with the clevis 36. The elongated housing 1 is able to continuously and smoothly spins as the rotating base plate 38 is terminally fixed to the shaft 37, positioned opposite the ring 35. Moreover, the rotating base plate 38 is oriented perpendicular with the shaft 37. The stationary base plate 39 is mounted into the handle portion 2 of the elongated housing 1, and the rotating base plate 38 is rotatably coupled with the stationary base plate 39. This arrangement allows the elongated housing 1 to spin about the shaft 37 as the ring 35 and shaft 37 are being held by the user. In order for the elongated housing 1 to smoothly spin about the shaft 37, the shaft 37 is oriented perpendicular to a central axis 18 of the elongated housing 1. More specifically, the stationary base is centrally aligned with the handle portion 2 of the elongated housing 1.

The emission of bubbles is controllable by the user as the present invention further comprises a switch 40. The switch 40 turns on and turns off the emission of bubbles. The switch 40 is accessible by the user as the switch 40 is externally integrated into the handle portion 2 of the elongated housing 1. The switch 40 is electronically connected to the microcontroller 31 allowing the user to input commands, turning on and turning off the motor 28, the pump 29, and the at least one fan mechanism 24. In various embodiments of the present invention, the additional control buttons and control dials may be electronically controlled to the microcontroller 31 in order to vary the rate of bubble emission.

In order for bubbles to be produced, the present invention further comprises an input tube 41 and at least one output tube 43. The input tube 41 delivers bubble solution from the solution reservoir 30 to the pump 29. The output tube delivers the bubble solution from the pump 29 to the at least one dispensing assembly 19. The bubble emission is smooth and continuous, even while the elongated housing 1 is being maneuvered by the user, as at least one dispensing assembly 19 and the at least one fan mechanism 24 are mounted within the elongated housing 1. The at least one dispensing assembly 19 is positioned adjacent the at least one outlet 9 and is oriented towards the at least one outlet 9, allowing the bubbles to traverse through the elongated housing 1 uninhibited. In order to direct the air flow towards the bubble solution emitted by the at least one dispensing assembly 19, the at least one fan mechanism 24 is positioned adjacent the at least one dispensing assembly 19, opposite the at least one outlet 9. Moreover, the at least one fan mechanism 24 is oriented towards the at least one dispensing assembly 19. The bubble supply is safely and securely retrieved from the solution reservoir 30 as the supply solution reservoir 30 is in fluid communication with the pump 29 through the input tube 41. The bubble solution traverses through the elongated housing 1 without coming into contact with and wetting the surrounding components as the pump 29 is in fluid communication with the at least one dispensing assembly 19 through the at least one output tube 43.

Bubbles are emitted from both ends of the elongated housing 1 as the at least one dispensing assembly 19 comprises a first dispensing assembly 20 and a second dispensing assembly 21. Similarly, the at least one fan mechanism 24 comprises a first fan mechanism 25 and a second fan mechanism 26. The first dispensing assembly 20, the second dispensing assembly 21, the first fan mechanism 25, and the second fan mechanism 26 are contained and positioned within the elongated housing 1. In order to position the first dispensing assembly 20 and the first fan mechanism 25 within the elongated housing 1 opposite the second dispensing assembly 21 and the second fan mechanism 26, the at least one dispensing assembly 19 comprises a first dispensing end 7 and a second dispensing end 8. The bubbles exit the first dispensing end 7 and the second dispensing end 8 as the at least one outlet 9 comprises a first outlet 10 and a second outlet 11. In order for bubbles to exit both ends of the elongated housing 1, the handle portion 2 is positioned in between the first dispensing end 7 and the second dispensing end 8. Moreover, the first outlet 10 traverses into the first dispensing end 7, and the second outlet 11 traverses into the second dispensing end 8. Bubbles exit the first outlet 10 as the first dispensing assembly 20 and the first fan mechanism 25 are positioned adjacent the first outlet 10. Bubbles exit the second outlet 11 as the second dispensing assembly 21 and the second fan mechanism 26 is positioned adjacent the second outlet 11.

In order to generate bubbles, specifically a smaller bubble within a larger bubble, the at least one dispensing assembly 19 comprises a first frame 22 and a second frame 23. The at least one fan mechanism 24 comprises a plurality of blade in order to generate air flow. The first frame 22 and the second frame 23 retain and distribute the bubble solution allowing the air flow from the at least one fan mechanism 24 to create a bubble from the bubble solution spread across the first frame 22 and the second frame 23. The distribution of the bubbles solution across the first frame 22 and the second frame 23 creates a sheet of bubble solution on the first frame 22 and a sheet of bubble solution on the second frame 23. In the preferred embodiment of the present invention, both the first frame 22 and the second frame 23 comprise a circular structure. Moreover, the first frame 22 is larger than the second frame 23. The bubble solution is distributed across the first frame 22 and the second frame 23 is secured as the elongated housing 1 is maneuvered by the user as the first frame 22 and the second frame 23 is mounted within the elongated housing 1. In order for a smaller bubble to be positioned within a larger bubble, the second frame 23 is positioned coincident with the first frame 22. Moreover, the second frame 23 is positioned concentric with the first frame 22. An outlet 44 of the at least one output tube 43 is mounted onto the first frame 22, allowing the bubble solution to distribute across both the first frame 22 and the second frame 23.

Bubbles are continuously generated as an inlet 42 of the input tube 41 is in fluid communication with the pump 29, and the solution reservoir 30 is in fluid communication with the pump 29 through the input tube 41. This arrangement also allows bubble solution to be delivered to the first frame 22, and consequently the second frame 23. Air flow is continuously generated from the at least one fan mechanism 24 as the plurality of blades 27 is radially distributed about an output shaft 37 of the motor 28. The output shaft 37 of the motor 28 is positioned adjacent the first frame 22 and the second frame 23 in order for air flow to be directed towards the sheets of bubble solution on the first frame 22 and the second frame 23.

Alternate embodiments of the present invention may further comprise a first motor and a second motor. In these alternate embodiments, the performance of the first fan mechanism 25 and the second fan mechanism 26 is enhanced as the first motor drives the airflow out of only the first outlet 10 and the second motor drives the airflow out of only the second outlet 11. The plurality of blades 27 of the first fan mechanism 25 is radially distributed about an output shaft of the first motor. Similarly, the plurality of blades 27 of the second fan mechanism 26 is radially distributed around an output shaft of the second motor. The output shaft of the first motor is positioned adjacent the first frame 22 and the second frame 23 of the first dispensing assembly 20, and the output shaft of the second motor is positioned adjacent the first frame 22 and the second frame 23 of the second dispensing assembly 21. As in the preferred embodiment of the present invention the microcontroller 31 is electronically connected to both the first motor and the second motor. The first motor and the second motor receive the necessary power as the power source 32 is electrically connected to both the first motor and the second motor.

In order to collect any excess bubble solution that is not retained by the first frame 22 and the second frame 23, the present invention comprises a funnel 45. The funnel 45 is mounted within the elongated housing 1 and is positioned in between the at least one dispensing assembly 19 and the solution reservoir 30. The flow of bubble solution through the funnel 45 is delivered back to the solution reservoir 30 as an inlet 46 of the funnel 45 is positioned adjacent the at least one dispensing assembly 19, and an outlet 47 of the funnel 45 is in fluid communication with the solution reservoir 30.

The emission of bubbles is enhanced as the preferred embodiment of the present invention comprises at least one light source 48 and a speaker 49. The at least one light source 48 emits light and the speaker 49 emits sound, preferably songs. In this preferred embodiment of the present invention, the elongated housing 1 comprises translucent materials in order for the light from the at least one light source 48 to be visible without exposing all the components contained within the elongated housing 1. The speaker 49 is externally integrated into the elongated housing 1 so that the elongated housing 1 does not muffle the sound. Moreover, the speaker 49 is positioned within the handle portion 2 of the elongated housing 1. The at least one light source 48 is mounted with the at least one dispensing end 6 of the elongated housing 1, thereby visually emphasizing the emission of bubbles. Moreover, this arrangement allows the user to grip the handle portion 2 without covering the light emitted by the at least one light source 48. The rate and pattern of both the light and sound emission is controlled as the microcontroller 31 is electronically connected to the at least one light source 48 and the speaker 49. Moreover, the power source 32 is electrically connected to the at least one light source 48 and the speaker 49.

Although the invention has been explained in relation to its preferred embodiment, it is to be understood that many other possible modifications and variations can be made without departing from the spirit and scope of the invention as hereinafter claimed.

What is claimed is:

1. An automatic bubble dispensing wand comprises:
an elongated housing;
at least one dispensing assembly;
at least one fan mechanism;
a motor;
a pump;
a solution reservoir;
a microcontroller;
a power source;
the elongated housing comprises a handle portion, at least one dispensing end, at least one outlet, and an inlet;
the at least one dispensing end being terminally positioned adjacent the handle portion;
the at least one outlet traversing into the at least one dispensing end;
the inlet traversing into the handle portion;
the at least one dispensing assembly, the at least one fan mechanism, the motor, the pump, the solution reservoir, the microcontroller, and the power source being positioned within the elongated housing;
the solution reservoir being in fluid communication with the pump;
the pump being in fluid communication with the at least one dispensing assembly;
the microcontroller being electronically connected to the at least one fan mechanism, the motor, and the pump;
the power source being electrically connected to the microcontroller, the at least one fan mechanism, the motor, and the pump; a spinning mechanism;
the spinning mechanism comprises a ring, a clevis, a shaft, a rotating base plate, and a stationary base plate;
the ring being hingedly engaged to the shaft with the clevis;
the rotating base plate being terminally fixed to the shaft, positioned opposite the ring;
the rotating base plate being oriented perpendicular with the shaft;
the stationary base plate being mounted into the handle portion of the elongated housing; and
the rotating base plate being rotatably coupled with the stationary base plate.

2. The automatic bubble dispensing wand as claimed in claim 1 comprises:

the at least one dispensing end comprises a first dispensing end and a second dispensing end;

the at least one outlet comprises a first outlet and a second outlet;

the first dispensing end being positioned adjacent the handle portion;

the second dispensing end being positioned adjacent the handle portion, opposite the first dispensing end;

the first outlet traversing into the first dispensing end; and the second outlet traversing into the second dispensing end.

3. The automatic bubble dispensing wand as claimed in claim 1 further comprises:

the handle portion tapering from a first distal end of the handle portion to a central plane of handle portion;

the handle portion tapering from a second distal end of the handle portion to the central plane of the handle portion; and the first distal end being positioned opposite the second distal end across the handle portion.

4. The automatic bubble dispensing wand as claimed in claim 1 comprises:

the elongated housing comprises a first elongated case and a second elongated case;

an opening of the first elongated case being positioned adjacent an opening of the second elongated case;

the first elongated case being coextensive with the second elongated case;

the at least one dispensing assembly, the at least one fan mechanism, the motor, the pump, the solution reservoir, the microcontroller, and the power source being mounted within the second elongated case; and the first elongated case being removable attached to the second elongated case.

5. The bubble dispensing wand as claimed in claim 4 comprises:

the inlet traversing through the first elongated case.

6. The automatic bubble dispensing wand as claimed in claim 1 comprises:

a cap;

the cap being externally positioned adjacent the elongated housing; and the cap being removably attached to a rim of the inlet.

7. The automatic bubble dispensing wand as claimed in claim 6 comprises:

the shaft being oriented perpendicular to a central axis of the elongated housing; and the stationary base being centrally aligned with the handle portion of the elongated housing.

8. The automatic bubble dispensing wand as claimed in claim 1 comprises:

a switch;

the switch being externally integrated into the handle portion of the elongated housing; and the switch being electronically connected to the microcontroller.

9. The automatic bubble dispensing wand as claimed in claim 1 comprises:

an input tube;

at least one output tube;

the at least one dispensing assembly and the at least one fan mechanism being mounted within the elongated housing;

the at least one dispensing assembly being positioned adjacent the at least one outlet;

the at least one dispensing assembly being oriented towards the at least one outlet;

the at least one fan mechanism being positioned adjacent the at least one dispensing assembly, opposite the at least one outlet;

the at least one fan mechanism being oriented towards the at least one dispensing assembly;

the solution reservoir being in fluid communication with the pump through the input tube; and the pump being in fluid communication with the at least one dispensing assembly through the at least one output tube.

10. The automatic bubble dispensing wand as claimed in claim 9 comprises:

the at least one dispensing assembly comprises first dispensing assembly and a second dispensing assembly;

the at least one fan mechanism comprises a first fan mechanism and a second fan mechanism;

the at least one dispensing end comprises a first dispensing end and a second dispensing end;

the at least one outlet comprises a first outlet and a second outlet;

the handle portion being positioned in between the first dispensing end and the second dispensing end;

the first outlet traversing into the first dispensing end;

the second outlet traversing into the second dispensing end;

the first dispensing assembly and the first fan mechanism being positioned adjacent the first outlet; and the second dispensing assembly and the second fan mechanism being positioned adjacent the second outlet.

11. The automatic bubble dispensing wand as claimed in claim 9 comprises:

the at least one dispensing assembly comprises a first frame, a second frame;

the at least one fan mechanism comprises a plurality of blades;

the first frame and the second frame being mounted within the elongated housing;

the second frame being positioned coincident with the first frame;

the second frame being positioned concentric with the first frame;

an outlet of the at least one output tube being mounted onto the first frame;

an inlet of the input tube being in fluid communication with pump;

the solution reservoir being in fluid communication with the pump through the input tube;

the plurality of blades being radially distributed about an output shaft of the motor; and the output shaft of the motor being positioned adjacent the first frame and the second frame.

12. The automatic bubble dispensing wand as claimed in claim 1 comprises:

a funnel;

the funnel being mounted within the elongated housing;

the funnel being positioned in between the at least one dispensing assembly and the solution reservoir;

an inlet of the funnel being positioned adjacent the at least one dispensing assembly; and an outlet of the funnel being in fluid communication with the solution reservoir.

13. The automatic bubble dispensing wand as claimed in claim 1 comprises:

at least one light source;

a speaker;

the speaker being externally integrated into the elongated housing;

the speaker being positioned within handle portion of the elongated housing;

the at least one light source being mounted within the at least one dispensing end of the elongated housing;

the microcontroller being electronically connected to the at least one light source and the speaker; and the power source being electrically connected to the at least one light source and the speaker.

* * * * *